US008978924B1

(12) United States Patent
Liu

(10) Patent No.: US 8,978,924 B1
(45) Date of Patent: Mar. 17, 2015

(54) BOX EQUIPPED WITH DUAL-COLORED HANDLE

(71) Applicant: Yung-Yuan Liu, Taichung (TW)

(72) Inventor: Yung-Yuan Liu, Taichung (TW)

( * ) Notice: Subject to any disclaimer, the term of this patent is extended or adjusted under 35 U.S.C. 154(b) by 0 days.

(21) Appl. No.: 14/020,557

(22) Filed: Sep. 6, 2013

(51) Int. Cl.

| | |
|---|---|
| ***B65D 25/32*** | (2006.01) |
| ***B25G 1/10*** | (2006.01) |
| ***B25H 3/02*** | (2006.01) |
| ***B65D 25/28*** | (2006.01) |

(52) U.S. Cl.
CPC .. *B25H 3/02* (2013.01); *B25G 1/10* (2013.01); *B65D 25/2838* (2013.01)
USPC ..... 220/759; 220/770

(58) Field of Classification Search
CPC ..... B65D 25/32; B65D 25/2841; B65D 25/2838; B65D 25/2835; B65D 25/28; B65D 2501/24484; B65D 2501/24439; B65D 2501/24433; B65D 2501/24426
USPC ..... 220/755, 759, 767, 766, 770, 760, 769, 220/773, 775, 776, 752, 915.1; 206/373, 206/372; 190/117, 116, 118, 115; 294/170; 16/111.1, 114.1, 406, 407, 408, 409, 16/410, 411, 438, 439
See application file for complete search history.

(56) References Cited

U.S. PATENT DOCUMENTS 4,364,150 A * 12/1982 Remington ..... 16/409

* cited by examiner

*Primary Examiner* — Mickey Yu
*Assistant Examiner* — Allan Stevens

(57) ABSTRACT

A tool box is equipped with a dual-colored handle. The dual-colored handle includes a frame of a color and a pad of another color. The frame is formed with two axles. The pad is formed with two rings each. Each of the rings is placed around and on a corresponding one of the axles as the frame and the pad are joined together.

7 Claims, 5 Drawing Sheets

BOX EQUIPPED WITH DUAL-COLORED HANDLE

BACKGROUND OF INVENTION

1. Field of Invention

The present invention relates to a box and, more particularly, to a box equipped with a dual-colored handle.

2. Related Prior Art

People use tool boxes to contain various tools. The tools can easily be placed in the tool boxes for storage and transportation and taken from the tool boxes for use.

A first conventional tool box includes two shells. Each shell includes a first edge pivotally connected to the first edge of the other shell so that the tool box can be opened and closed. Each shell further includes a second edge that can be locked to the second edge of the other shell so that the tool box can be locked in the closed position. A handle is pivotally connected to the second edge of one of the shells. The shells are often made of a same color so that the first conventional tool box looks dull.

A second conventional tool box is identical to the first conventional tool box except including two handles each pivotally connected to the second edge of a corresponding one of the shells. The handles are often made of a same color so that the second conventional tool box looks dull too.

As disclosed in Taiwanese Patent M241195, a tool box includes a dual-colored buckle for locking two shells to each other.

As disclosed in Taiwanese Patent M271680, a tool box includes two shells made of different colors. More dual-colored tool boxes can be seen in Taiwan Patents D115800 and D152808.

Therefore, the present invention is intended to obviate or at least alleviate the problems encountered in prior art.

SUMMARY OF INVENTION

It is the primary objective of the present invention to provide a tool box with an aesthetically pleasant handle.

To achieve the foregoing objective, the handle includes a frame of a color and a pad of another color. The frame is formed with two axles. The pad is formed with two rings each. Each of the rings is placed around and on a corresponding one of the axles as the frame and the pad are joined together.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
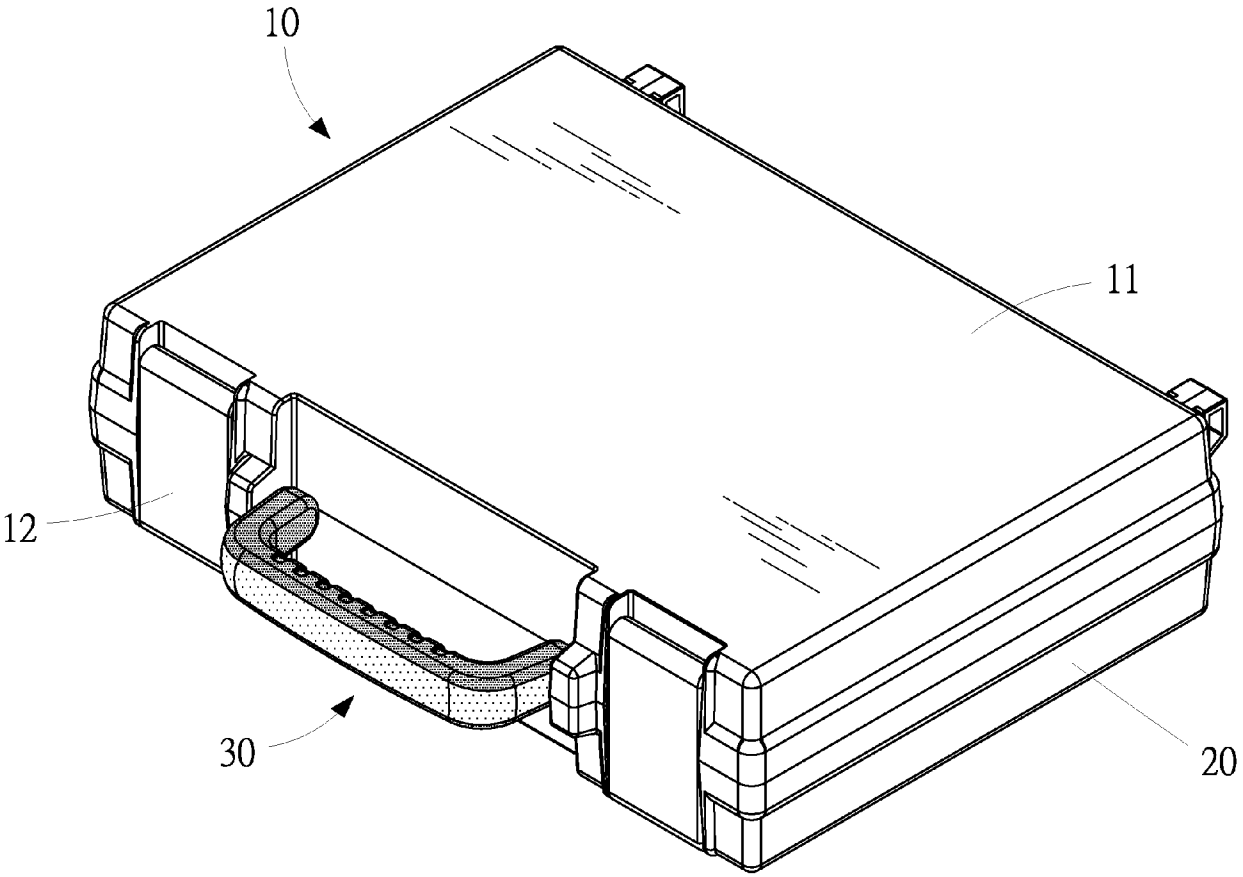
FIG. 1 is a perspective view of a tool box including a dual-colored handle according to the preferred embodiment of the present invention.

Referring to FIG. 1, there is shown a tool box 10 according to the preferred embodiment of the present invention. The tool box 10 includes two shells 11 and 20, two buckles 12 and a dual-colored handle 30. Each of the shells 11 is formed with two opposite edges. The first edge of the shell 11 is pivotally connected to the first edge of the shell 20.

The shell 11 includes two hoods 13, a recess 14, and two lugs 17 at the second edge. Each hood 13 includes a space 15 for receiving an upper portion of a corresponding lug 17 while a lower portion of the lug 17 is placed out of the hood 13. Each hood 13 includes a semi-circular cutout 16 that faces the semi-circular cutout 16 of the other hood 13. The recess 14 is made between the hoods 13. Each lug 17 includes an aperture 18.

The shell 20 includes two hoods 21 and a recess 22 at the second edge. Each hood 21 includes a space 23 for receiving the lower portion of a corresponding lug 17. Each hood 21 includes a semi-circular cutout 24 that faces the semi-circular cutout 24 of the other hood 21. The recess 22 is made between the hoods 21.

Figure 3:
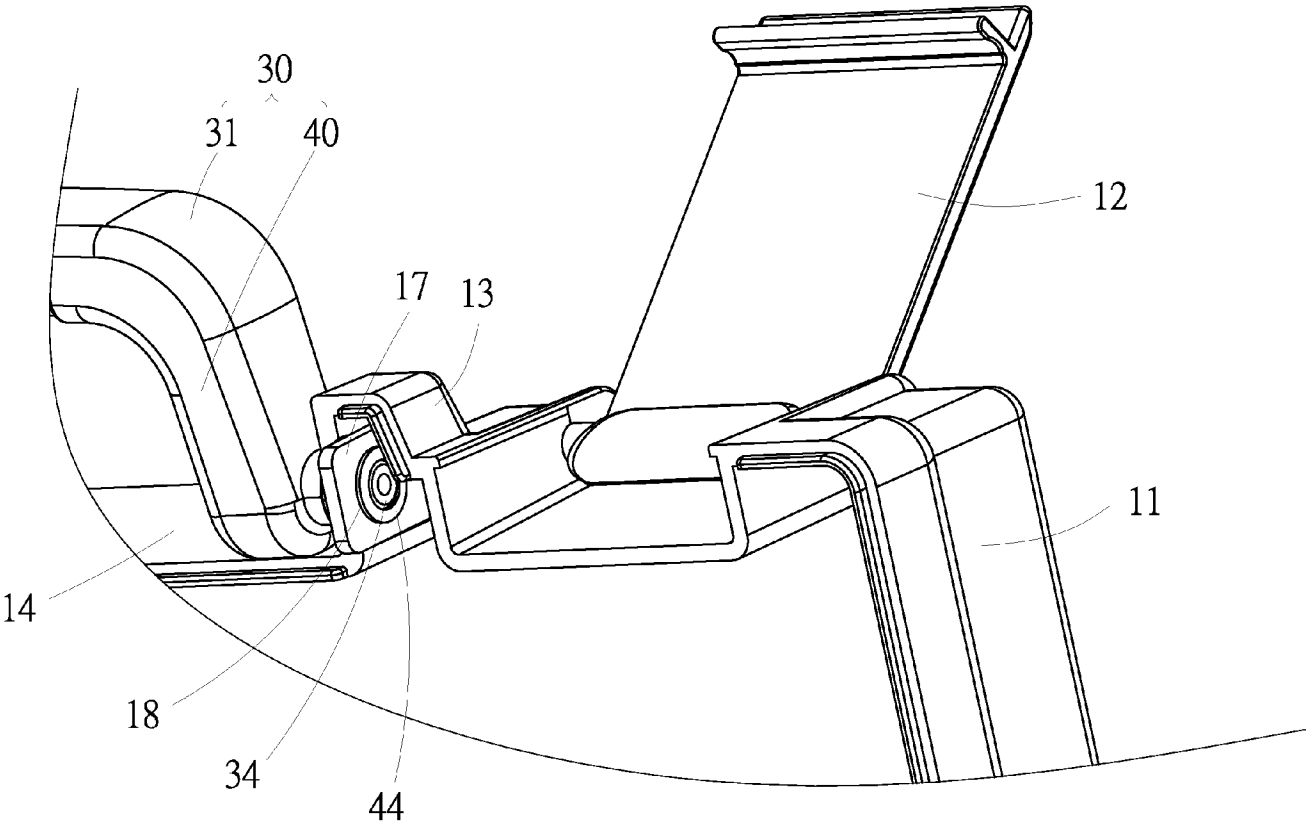
FIG. 3 is an enlarged partial view of the tool box shown in FIG. 1.

Referring to FIG. 3, the buckles 12 are pivotally connected to the second edge of the shell 11. The buckles 12 are movable between a locking position and an unlocking position. The buckles 12, in the locking position, are engaged with the second edge of the shell 20. The buckles 12, in the unlocking position, are disengaged from the second edge of the shell 20.

Figure 2:
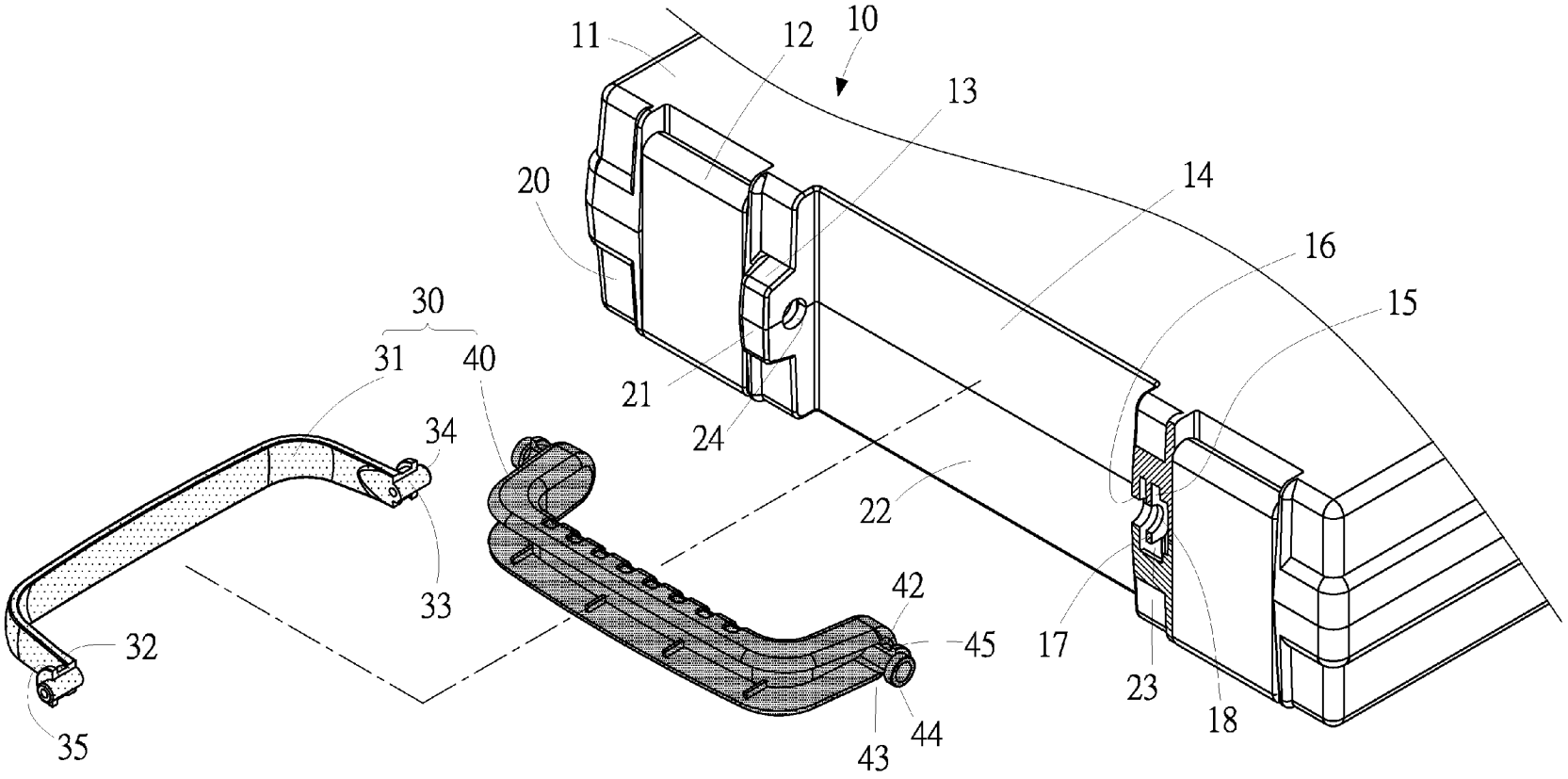
FIG. 2 is an exploded view of the tool box shown in FIG. 1.
Figure 4:
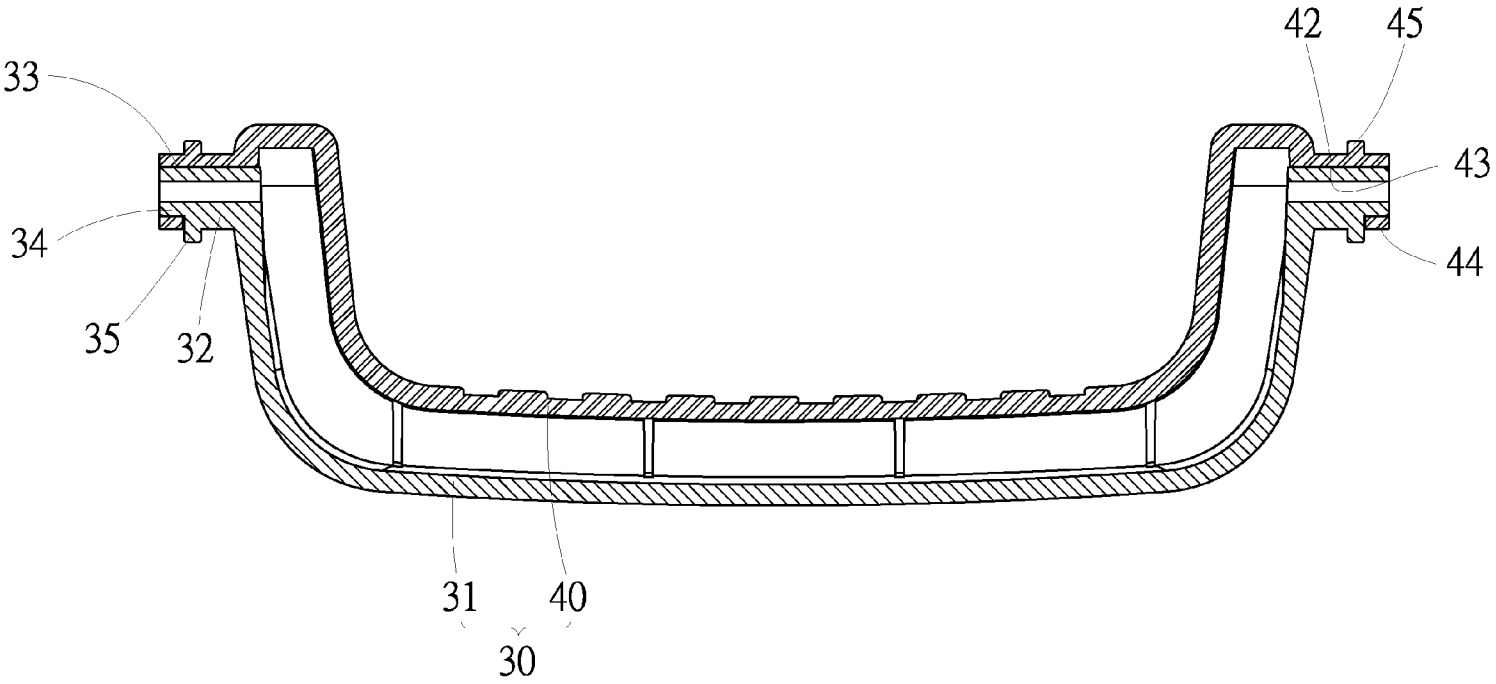
FIG. 4 is an enlarged cross-sectional view of the dual-colored handle shown in FIG. 1.

Referring to FIGS. 2 and 4, the dual-colored handle 30 includes a frame 31 and a pad 40. The frame 31 is made of a rigid material to provide rigidity and strength. The frame 31 is made of a color. The frame 31 includes two axles 33 each formed at an end, two semi-tubes 32 each formed on a corresponding one of the axles 33, and two arched flanges 35 each formed on a corresponding one of the axles 33. Each semi-tube 32 is formed next to the corresponding arched flange 35. The arched flanges 35 extend beyond the semi-tubes 32 in a radial direction of the axles 33. Each axle 33 includes an end 34.

The pad 40 is made of a soft material to provide a soft feel for a user. The pad 40 is made of another color than that of the frame 31. The pad 40 includes two semi-tubes 42 each formed at an end, two arched flanges 45 each formed next to a corresponding one of the semi-tubes 42, and two rings 44 each formed next to a corresponding one of the arched flanges 45. Each semi-tubes 42 includes an arched concave face 43. The arched flanges 45 extend beyond the semi-tubes 42 in a radial direction.

The end 34 of each axle 33 is inserted in a corresponding ring 44 to connect the frame 31 to the pad 40. An arched convex face of each axle 33 is in tight contact with the arched concave face 43 of a corresponding semi-tube 42. The semi-tube 32 of each axle 33 and the corresponding semi-tube 42 together form an annular portion. The arched flange 35 of each axle 33 and a corresponding arched flange 45 together form an annular flange. Advantageously, the dual-colored handle 30 is robust, comfortable to use and aesthetically pleasant.

Figure 5:
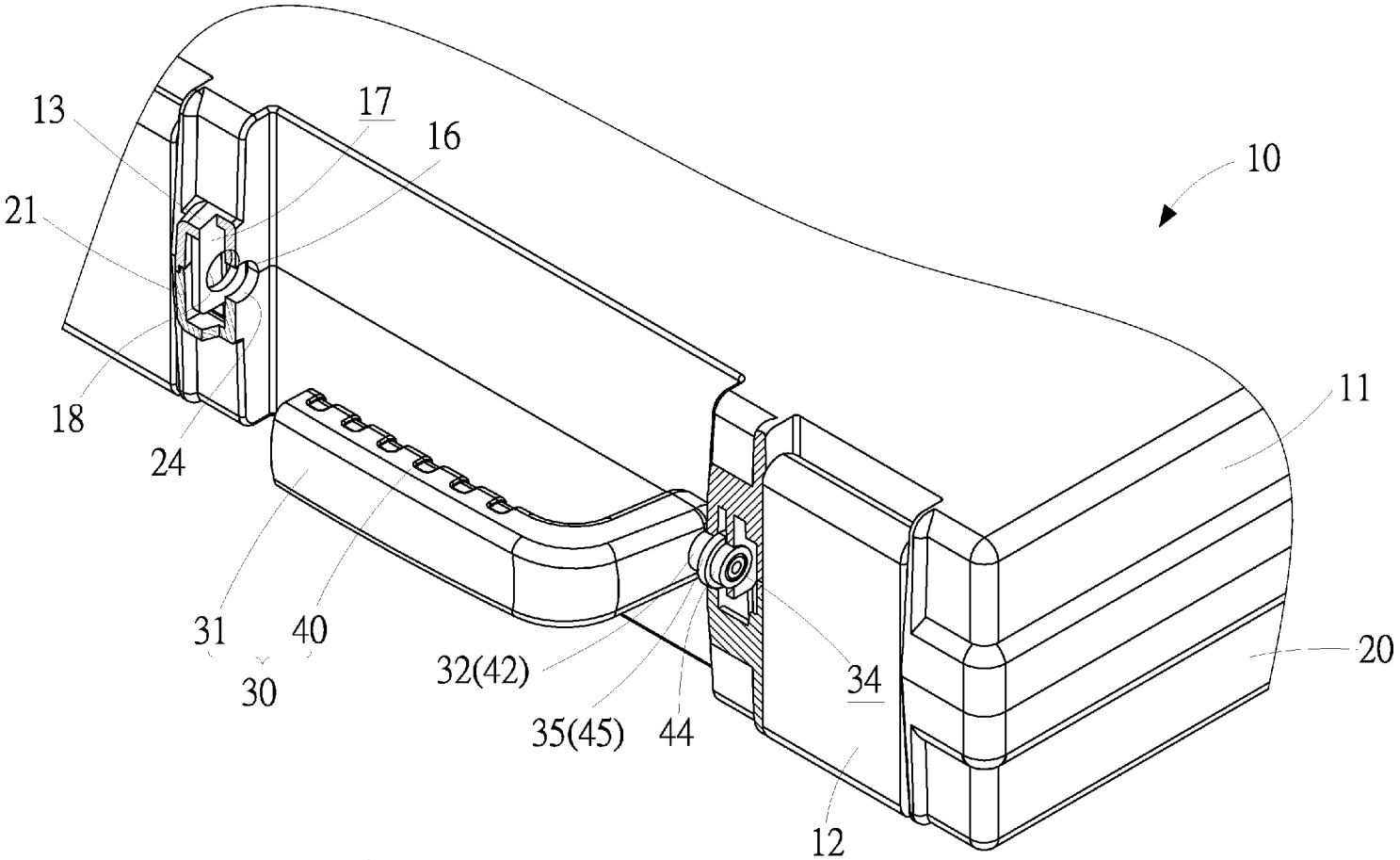
FIG. 5 is an enlarged cut-away view of the tool box shown in FIG. 1.

Referring to FIG. 5, the rings 44 are inserted in the apertures 18 of the lugs 17 so that the dual-colored handle 30 is pivotally connected to the shell 11. The annular flanges, which consist of the arched flanges 35 and 45, are in contact with the lugs 17 to retain the position of the dual-colored handle 30 on the shell 11 in an axial direction of the apertures 18. The second edge of the shell 11 is placed on the second edge of the shell 20 when the tool box 10 is closed. Each semi-circular cutout 16 and a corresponding semi-circular cutout 24 together become a circular aperture for receiving a corresponding annular portion, which consists of the semi-tube 32 of the corresponding axle 33 and the corresponding semi-tube 42. Thus, the rings 44, the flanges 45 and 35 are concealed by the hooks 13 and 23 when the tool box 10 is closed.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A dual-colored handle including:

a frame made of a color and formed with two axles and two semi-tubes each formed on a corresponding one of the axles; and a pad made of another color and formed with:

two rings each placed around and on the axles as the frame and the pad are joined together; and two semi-tubes each formed in the vicinity of a corresponding one of the rings, wherein each of the semi-tubes of the frame and a corresponding one of the semi-tubes of the pad together form a tube when the corresponding axle is inserted in the corresponding ring.

2. The dual-colored handle according to claim 1, wherein the frame includes two arched flanges each formed on a corresponding one of the semi-tubes of the frame, wherein the pad includes two arched flanges each formed next to a corresponding one of the semi-tubes of the pad, wherein each of the arched flanges of the frame and a corresponding one of the arched flanges of the pad together form an annular flange as the corresponding axle is inserted in the corresponding ring.

3. A tool box including the dual-colored handle according to claim 2 pivotally connected thereto.

4. The tool box according to claim 3, including:

a first shell including a first edge, a second edge opposite to the first edge, and two lugs formed on the second edge, wherein the rings are pivotally supported on the lugs; and a second shell including a first edge pivotally connected to the first edge of the first shell and a second edge opposite to the first edge of the second shell.

5. The tool box according to claim 4, wherein the first shell includes two hoods formed at the second edge of the first shell, wherein the second shell includes two hoods formed at the second edge of the second shell, wherein each of the hoods of the first shell and a corresponding one of the hoods of the second shell together form a shield for concealing a corresponding one of the rings, a corresponding one of the tubes and a corresponding one of the annular flanges when the tool box is closed.

6. The tool box according to claim 5, wherein each of the hoods of the first and second shells includes a cutout, wherein the cutout of each of the hoods of the first shell and the cutout of a corresponding one of the hoods of the second shell together become an aperture for receiving a corresponding one of the tubes.

7. The tool box according to claim 4, including two buckles pivotally connected to the second edge of the first shell and operable for engagement with the second edge of the second shell.

* * * * *